US010062487B2

(12) United States Patent
Wang et al.

(10) Patent No.: US 10,062,487 B2
(45) Date of Patent: Aug. 28, 2018

(54) STRONG-MAGNETIC-FOCUSED MAGNET SYSTEM WITH TERAHERTZ SOURCE

(71) Applicant: Institute of Electrical Engineering, Chinese Academy of Sciences, Beijing (CN)

(72) Inventors: Qiuliang Wang, Beijing (CN); Xinning Hu, Beijing (CN); Yinming Dai, Beijing (CN)

(73) Assignee: Institute of Electrical Engineering, Chinese Academy of Sciences, Beijing (CN)

( * ) Notice: Subject to any disclaimer, the term of this patent is extended or adjusted under 35 U.S.C. 154(b) by 0 days.

(21) Appl. No.: 15/547,263

(22) PCT Filed: Jan. 12, 2016

(86) PCT No.: PCT/CN2016/070629
§ 371 (c)(1),
(2) Date: Jul. 28, 2017

(87) PCT Pub. No.: WO2016/119589
PCT Pub. Date: Aug. 4, 2016

(65) Prior Publication Data

US 2017/0372824 A1 Dec. 28, 2017

(30) Foreign Application Priority Data

Jan. 30, 2015 (CN) ..... 2015 1 0050788

(51) Int. Cl.
*H01F 7/00* (2006.01)
*H01F 6/06* (2006.01)
*H01F 6/04* (2006.01)

(52) U.S. Cl.
CPC ..... *H01F 6/06* (2013.01); *H01F 6/04* (2013.01)

(58) Field of Classification Search
CPC ..... H01F 6/00
USPC ..... 335/216
See application file for complete search history.

(56) References Cited

U.S. PATENT DOCUMENTS 3,686,458 A * 8/1972 Denel ..... H01L 39/20 200/262
4,924,198 A * 5/1990 Laskaris ..... G01R 33/3815 174/15.4
5,404,122 A * 4/1995 Maeda ..... H01F 6/02 335/216
7,098,663 B1 * 8/2006 Hollis ..... G01R 33/3815 324/320
7,439,836 B2 * 10/2008 Lvovsky ..... G01R 33/3806 335/216

(Continued)

FOREIGN PATENT DOCUMENTS

CN 101552077 A 10/2009
CN 101819845 A 9/2010

(Continued)

*Primary Examiner* — Alexander Talpalatski
(74) *Attorney, Agent, or Firm* — The Webb Law Firm

(57) ABSTRACT

A strong-magnetic focused magnet system with a terahertz source includes a first superconducting main coil and a second superconducting main coil. The second superconducting main coil surrounds the outer surface of the first superconducting main coil, and the second superconducting main coil is coaxial with the first superconducting main coil.

13 Claims, 2 Drawing Sheets

(56) References Cited

U.S. PATENT DOCUMENTS

| | | | | |
|---|---|---|---|---|
| 7,852,079 | B2 * | 12/2010 | Huang | G01R 33/3815 324/318 |
| 7,889,034 | B2 * | 2/2011 | Lee | G01R 33/3815 324/319 |
| 8,204,563 | B2 * | 6/2012 | Wang | G01R 33/288 335/216 |
| 8,258,903 | B2 * | 9/2012 | Schnur | G01R 33/3815 324/318 |
| 8,487,730 | B2 * | 7/2013 | Hahn | G01R 33/3804 335/216 |
| 8,988,176 | B2 * | 3/2015 | Aoki | G01R 33/3815 324/318 |
| 2005/0110491 | A1 * | 5/2005 | Havens | G01R 33/3815 324/318 |

FOREIGN PATENT DOCUMENTS

| | | | |
|---|---|---|---|
| CN | 102360690 | A | 2/2012 |
| CN | 202632926 | U | 12/2012 |
| CN | 104599805 | A | 5/2015 |
| JP | 2014056872 | A | 3/2014 |
| WO | 2011094917 | A1 | 8/2011 |
| WO | 2012096644 | A1 | 7/2012 |

* cited by examiner

STRONG-MAGNETIC-FOCUSED MAGNET SYSTEM WITH TERAHERTZ SOURCE

CROSS-REFERENCE TO RELATED APPLICATIONS

This application is the United States national phase of International Application No. PCT/CN2016/070629 filed Jan. 12, 2016, and claims priority to Chinese Patent Application No. 201510050788.1 filed Jan. 30, 2015, the disclosures of which are hereby incorporated in their entirety by reference.

FIELD OF THE INVENTION

The present invention relates to the field of terahertz technology, and more particularly to a strong-magnetic focused magnet system with a terahertz source.

BACKGROUND

Terahertz (THz) waves generally refer to electromagnetic waves having frequencies ranged from 0.1 to 10 THz. From a view of frequency, THz waves are located between radio waves and light waves, or between millimeter waves and infrared waves, that is, the frequency of THz waves is higher than that of microwaves and is below than that of infrared waves. From a view of energy, the energy of THz waves is between the energy of electrons and the energy of photons. Techniques relating to infrared and microwave, which are distributed on both sides of the THz band in the electromagnetic spectrum, are mature techniques, but techniques on THz is still a blank field for the reason that neither optical theory nor microwave theory is completely suitable for the band of THz. THz systems have a wide range of applications in many fields, such as semiconductor materials, property study of high temperature superconducting materials, tomography technology, unmarked genetic testing, cell-level imaging, chemical and biological inspection, broadband communications, microwave orientation and the like. The study of radiation sources in this band will not only promote the development of the theorical researches, but also present a major challenge to solid-state electronics and circuit technology. It is expected that THz technology will be one of the major emerging science and technology fields in the 21st century.

Currently, conventional electromagnetic fields with lower magnetic field intensities are mainly adopted as magnetic fields of THz sources. There is a need in the art for a more movable and lighter strong-magnetic field focusing system to meet the needs of the usage of high-power THz sources. Also, since the strong-magnetic focusing magnet system utilized in high-power THz sources has a complex magnetic field shape and a higher requirement for the precision of the magnetic field, an improved coil structure is required to achieve the magnetic field intensity and special spatial configuration of the magnetic field required by a high-power THz system. Conventional strong-magnetic focusing magnet systems used for traditional high-power THz sources provide a lower magnetic field intensity, poor field stability, and unsatisfied field precision.

DISCLOSURE OF THE INVENTION

Accordingly, provided is an improved strong magnetic focused magnet system, which can be used with high-power THz sources to increase magnetic field intensity, field stability, and field precision. New superconducting materials and cooling methods enable a strong-magnetic focusing magnet system used for high-power THz sources.

According to an aspect of the present invention, a strong-magnetic focusing magnet system for a terahertz source is provided, comprising: two superconducting main coils, four superconducting correction coils, and two cathode magnetic field compensation superconducting coils; a first superconducting main coil disposed at the center of the strong-magnetic focusing magnet system, a second superconducting main coil coaxially surrounding an outer surface of the first superconducting main coil; a first superconducting correction coil coaxially surrounding an outer surface of the second superconducting main coil; a second superconducting correction coil coaxially surrounding an outer surface of the first superconducting correction coil; a third superconducting correction coil coaxially surrounding an outer surface of the second superconducting main coil, in parallel to the first superconducting correction coil 3 in the axial direction of the second superconducting main coil 2; a fourth superconducting correction coil coaxially surrounding an outer surface of the third superconducting correction coil; a first cathode magnetic field compensation superconducting coil and a second cathode magnetic field compensation superconducting coil disposed on both ends of the first superconducting main coil and the second superconducting main coil in the axial direction respectively; the two superconducting main coils, four superconducting correction coils, and two cathode magnetic field compensation superconducting coils constituting a magnet system; wherein each of the superconducting coils is internally provided with distributed solid cold-guide Litz wires, a plurality of microfluidic heat exchanger are wound around the surface of each superconducting coil, the distributed solid cold-guide Litz wires and the microfluidic heat exchanger are connected to a refrigerator; the magnet system is cured in a vacuum impregnation process by a rare earth material doped an epoxy resin.

Further, the gap between the first superconducting main coil and the second superconducting main coil is 5 mm; the gap between the first superconducting correction coil and the second superconducting main coil is 6 mm; the gap between the second superconducting correction coil and the first superconducting correction coil is 3 mm; the gap between the third superconducting correction coil and the second superconducting main coil is 6 mm; the gap between the fourth superconducting correction coil and the third superconducting correction coil is 3 mm.

Further, each of the two superconducting main coils, the four superconducting correction coils and the two cathode magnetic field compensation superconducting coils is a solenoid coil, the two superconducting main coils are formed of a Nb3Sn superconducting wires, the four superconducting correction coils and the two cathode magnetic field compensation superconducting coils are formed of NbTi superconducting wires.

Further, the two superconducting main coils and the four superconducting correction coils together provide a central magnetic field of 16 T; the four superconducting correction coils produce a uniform space of 200 mm in the axial direction of the magnet system; the two cathodic magnetic field compensation superconducting coils are used to produce a magnetic field intensity of less than 3000 gauss at a cathode region outside the magnet system.

Further, the two superconducting main coils and the four superconducting correction coils are hierarchically arranged according to current densities in the radial direction of the superconducting wires, that is, the wire diameter of the first superconducting main coil is larger than the wire diameter of the second superconducting main coil, the wire diameter of the second superconducting main coil is larger than the wire diameter of the first superconducting correction coil, the wire diameter of the first superconducting correction coil is larger than the wire diameter of the second superconducting correction coil; the wire diameter of the second superconducting main coil is larger than the wire diameter of the third superconducting correction coil, the wire diameter of the third superconducting correction coil is larger than the wire diameter of the fourth superconducting correction coil.

Compared with the prior art, the present invention is formed by combining a plurality of superconducting coil structures comprising NbTi coils and Nb3Sn coils, and adopts microfluidic heat exchangers and Litz wires distributed cold-guide structure to greatly improve temperature uniformity of the magnet system. Further, stability of the superconducting coils is effectively improved by doping a rare earth to meet the need of operation of the magnet system in complex environments.

Other features and advantages of the present invention will become apparent from the following detailed description of exemplary embodiments of the present invention with reference to the accompanying drawings.

DESCRIPTION OF THE DRAWINGS

The accompanying drawings, which are included to provide a further understanding of the invention and are incorporated in and constitute a part of this specification, illustrate embodiments of the invention, and together with the illustrative embodiments of the present application serve to explain the present invention, but are not limitation thereof. In the drawings.

DETAILED DESCRIPTION OF PREFERRED EMBODIMENTS

Figure 1:
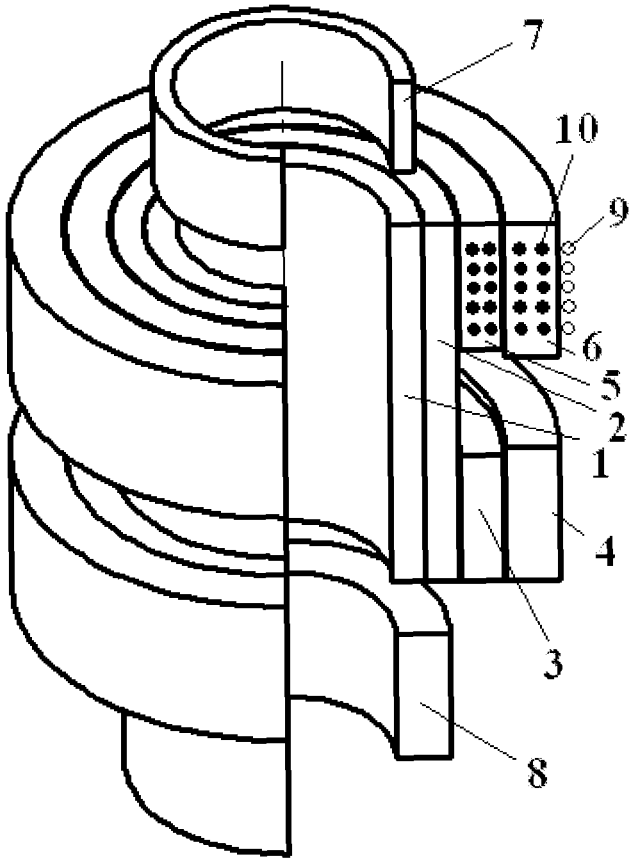
FIG. 1 is an overall electromagnetic structure diagram of the THz strong-magnetic focusing magnet system according to the present invention.

Various exemplary embodiments of the present invention will now be described in detail with reference to the accompanying drawings. Notice that, unless otherwise specified, the relative arrangement, numerical expressions and numerical values of the components and steps set forth in these examples do not limit the scope of the invention.

At the same time, it should be understood that, for ease of description, the dimensions of the various parts shown in the drawings are not drawn to actual proportions.

The following description of at least one exemplary embodiment is in fact merely illustrative and is in no way intended as an limitation to the invention, its application or use.

Techniques, methods, and apparatus known to those of ordinary skill in the relevant art may not be discussed in detail, but where appropriate, these techniques, methods, and apparatuses should be considered as part of the specification.

Of all the examples shown and discussed herein, any specific value should be construed as merely illustrative and not as a limitation. Thus, other examples of exemplary embodiments may have different values.

Notice that, similar reference numerals and letters are denoted by the like in the accompanying drawings, and therefore, once an item is defined in a drawing, there is no need for further discussion in the accompanying drawings.

For a clear understanding of the object of the present invention, its technical solution and advantages, the present invention will be further described in detail below in conjunction with the accompanying drawings and embodiments.

As shown in FIG. 1, a strong-magnetic focusing magnet system for a high-power THz source comprises a first superconducting main coil 1 and a second superconducting main coil 2, the second superconducting main coil 2 surrounds the outer surface of the first superconducting main coil 1, and the second superconducting main coil 2 is coaxial with the first superconducting main coil 1.

In this embodiment, a strong-magnetic focusing magnet system for a THz source is formed by arranging a first superconducting main coil 1 and a second superconducting main coil 2 as main coils for producing a central magnetic field, which is capable of overcoming a problem of lower magnetic field intensity, poor field stability and unsatisfied field precision in the prior art.

The present invention may also adopt such an arrangement in which the first superconducting main coil 1 and the second superconducting main coil 2 are cylindrical solenoid coils and are formed of high performance Nb3Sn superconducting wires having higher current transmission characteristic. The gap between the outer surface of the first superconducting main coil 1 and the inner surface of the second superconducting main coil 2 is 3-8 mm, preferably, may be 5 mm, to facilitate adjustment to the highest magnetic field intensity of the magnet. Wherein, the first superconducting main coil 1 may be disposed at the center of the strong-magnetic focusing magnet system of the present invention and sustain a magnetic field intensity up to 16.5 T.

According to another embodiment of the present invention, as shown in FIG. 1, the system may further comprises a first superconducting correction coil 3 and a third superconducting correction coil 5. The first superconducting correction coil 3 surrounds the outer surface of the second superconducting main coil 2, and the first superconducting correction coil 3 is coaxial with the second superconducting main coil 2; the third superconducting correction coil 5 surrounds the outer surface of the second superconducting main coil 2, in parallel to the first superconducting correction coil 3 in the axial direction of the second superconducting main coil 2, and the third superconducting correction coil 5 is coaxial with the second superconducting main coil 2.

The system may further comprises a second superconducting correction coil 4 and a fourth superconducting correction coil 6. The second superconducting correction coil 4 surrounds the outer surface of the first superconducting correction coil 3 and the second superconducting correction coil 4 is coaxial with the first superconducting correction coil 3; the fourth superconducting correction coil 6 surrounds the outer surface of the third superconducting correction coil 5 and the fourth superconducting correction coil 6 is coaxial with the third superconducting correction coil 5.

Each of the four superconducting correction coils is solenoid coil and is formed of NbTi superconducting wire with lower cost. The gap between the inner surface of the first superconducting correction coil 3 and the outer surface of the second superconducting main coil 2 is 3-7 mm, preferably, may be 6 mm; the gap between the inner surface of the second superconducting correction coil 4 and the outer surface of the first superconducting correction coil 3 is 2-6 mm, preferably, may be 3 mm; the gap between the inner surface of the third superconducting correction coil 5 and the outer surface of the second superconducting main coil 2 is 3-7 mm, preferably, may be 6 mm; the gap between the inner surface of the fourth superconducting correction coil 6 and the outer surface of the third superconducting correction coil 5 is 2-6 mm, preferably, may be 3 mm. These various gaps are set to facilitate adjustment to the magnetic field uniformity of the magnet.

In this embodiment, the coil system comprising the first superconducting main coil 1, the second superconducting main coil 2, the first superconducting correction coil 3, the second superconducting correction coil 4, the third superconducting correction coil 5 and the fourth superconducting correction coil 6 may provide a uniform field region of 200 mm in the axial direction and a high magnetic field intensity of 16 T, wherein the magnetic field uniformity in the uniform field region is 0.1%-0.3%. That is, the first superconducting correction coil 3, the second superconducting correction coil 4, the third superconducting correction coil 5 and the fourth superconducting correction coil 6 may produce auxiliary correction magnetic fields to further improve the central magnetic field intensity.

According to still another embodiment of this invention, as shown in FIG. 1, in order to correct the cathode magnetic field intensity to 3000 gauss, a first cathode magnetic field compensation superconducting coil 7 and a second cathode magnetic field compensation superconducting coil 8 are disposed on two ends of the first superconducting main coil 1 and the second superconducting main coil 2 in the axial direction respectively. Both of the first cathode magnetic field compensation superconducting coil 7 and the second cathode magnetic field compensation superconducting coil 8 are solenoid coils and are formed of NbTi superconducting coils.

In this embodiment, a strong-magnetic focusing magnet system required by a high-power output THz source is produced by providing a required magnetic field intensity, compensating the inaccuracy of spatial magnetic field with distributed current and realizing the precision requirement to the magnetic field by eliminating the multi-level components.

In another embodiment of the present invention, in order to sufficiently improve the utilization of superconducting wires and reduce the cold weight of the magnet system, the two superconducting main coils 1, 2 and the four superconducting correction coils 3, 4, 5, 6 are hierarchically arranged according to radical current densities in their superconducting wires, i.e., the wire diameter of the first superconducting main coil 1 is larger than the wire diameter of the second superconducting main coil 2; the wire diameter of the second superconducting main coil 2 is larger than the wire diameter of the third superconducting correction coil 3, the wire diameter of the third superconducting correction coil 3 is larger than the wire diameter of the fourth superconducting correction coil 4; the wire diameter of the second superconducting main coil 2 is larger than the wire diameter of the third superconducting correction coil 5, the wire diameter of the third superconducting correction coil 5 is larger than the wire diameter of the fourth superconducting correction coil 6.

In this embodiment, the two superconducting main coils of the present invention, as a whole, are disposed at the center of the strong-magnetic focusing magnet system, the two cathode magnetic field compensation superconducting coils are disposed on two ends in the axis direction of the first superconducting main coil and the second superconducting main coil respectively to form a required uniform magnetic field region of 200 mm. In order to sufficiently improve the utilization of the superconducting wires and reduce the cold weight of the system, the two superconducting main coils, being main coils for producing a central magnetic field, are wound with high performance Nb3Sn wires having a higher current transmission characteristic and are hierarchically arranged based on their radical current densities. The superconducting correction coils are also arranged in such a way that the radial current density is gradually increased from inside to outside along the radical direction and are wound with lower-cost NbTi wires, so as to produce auxiliary correction magnetic fields to further increase the intensity of the central magnetic field. An electron beam generated in the cathode region of the THz source device moves at high speed toward the anode under the action of a high voltage electric field. An electronic deceleration system consisting of periodically distributed electrodes, between the cathode and anode, can form a periodically distributed potential field in which the electrons are allowed to form a periodic distribution of electron packets, which can produce THz radiation. The cathode region of the THz source, requiring a lower magnetic field intensity, is formed at two ends of the two superconducting main coils in the axial direction, thus it is necessary to perform rapid correction for the magnetic field with a uniform region. In the present invention, two cathode magnetic field compensation superconducting coils are respectively disposed at both ends in the axial direction of the two superconducting main coils, so that the field intensity of the high magnetic field region can be rapidly eliminated to a magnetic field level of 3000 gauss at the cathode region. Moreover, the present invention can meet the requirements of a complex thermal vacuum use environment and can meet the requirements of a field motion system, such as airborne, vehicle-mounted systems and the like, as well as aerospace use.

The strong-magnetic focusing magnet system of this invention adopts a plurality of cathode compensation superconducting coils to compensate the spatial distribution of the magnetic field to satisfy the required magnetic field accuracy of the THz source. The strong-magnetic focusing magnet system of this invention adopts a rare earth high heat capacity material doped an epoxy resin, which is cured in a vacuum impregnation process.

Figure 2:
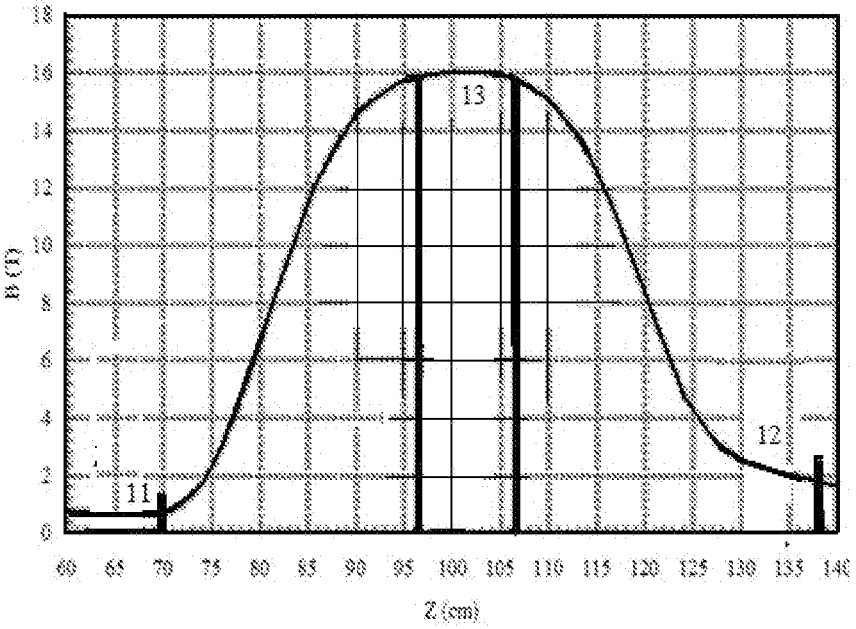
FIG. 2 is a schematic view showing the characteristics of a magnetic field distribution capable of producing a high-power THz source.

FIG. 2 shows a magnetic field distribution pattern required by a high-power THz source, wherein the magnetic field comprises a cathode region 11, a uniform region 13 and a collection region 12. This invention adopts a first cathode magnetic field compensation superconducting coil 7 and a second cathode magnetic field compensation superconducting coil 8 to satisfy the requirement of a magnetic field intensity less than 3000 gauss. The second cathode magnetic field compensation superconducting coil 8 can compensate the magnetic field requirement of the collection region 12. In this invention, the magnetic field distribution of the uniform region 13 is produced by the first superconducting main coil 1, the second superconducting main coil 2, the first superconducting correction coil 3, the second superconducting correction coil 4, the third superconducting correction coil 5 and the fourth superconducting correction coil 6 together.

Figure 3:
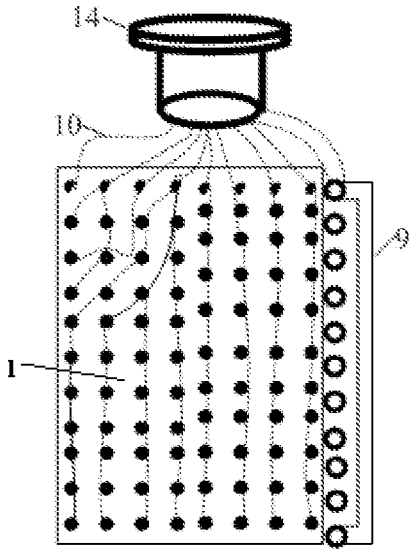
FIG. 3 shows a microfluidic heat exchanger and a distributed solid heat conducting structure.

In another embodiment of this invention, as shown in FIG. 1, the system further comprises a plurality of microfluidic heat exchangers 9 which are wound around the outer surfaces of the first superconducting main coil 1, the second superconducting main coil 2, the first superconducting correction coil 3, the second superconducting correction coil 4, the third superconducting correction coil 5, the fourth superconducting correction coil 6, the first cathode magnetic field compensation superconducting coil 7 and the second cathode magnetic field compensation superconducting coil 8 to increase the heat exchange area of the coil surfaces. As shown in FIG. 3, the microfluidic heat exchanger 9 is a metal tube, one end of which is connected to a secondary cold head 14 of the refrigerator. The microfluidic heat exchanger has a tube outer diameter of 0.5 to 1 mm, and the tube is filled with a helium gas. Cooling efficiency is improved by the heat transfer of the helium gas in the microfluidic heat exchanger 9.

The system further comprises distributed solid cold-guide Litz wires 10. The distributed solid cold-guide Litz wires 10 are uniformly distributed within the first superconducting main coil 1, the second superconducting main coil 2, the first superconducting correction coil 3, the second superconducting correction coil 4, the third superconducting correction coil 5, the fourth superconducting correction coil 6, the first cathode magnetic field compensation superconducting coil 7 and the second cathode magnetic field compensation superconducting coil 8. As shown in FIG. 3, each distributed solid cold-guide Litz wire 10 is a solid metal wire, one end of which is connected to the secondary cold head 14 of the refrigerator and the cooling energy of the secondary cold head 14 of the refrigerator is transmitted to the inside of each coil by the distributed solid cold-guide Litz wires 10.

In this embodiment, since the magnetic field for the strong-magnetic focusing magnet system may be as high as 16 T or above, a temperature uniformity inside the respective coils is used to sufficiently improve the output characteristics of the superconducting wires. In this invention, a plurality of high heat conducting microfluidic heat exchangers each having a diameter of 0.5 to 1 mm are uniformly wound around the outer surface of each coil, and distributed solid cold-guide Litz wires are arranged inside the respective coils to form distributed solid heat conduction to realize overall temperature uniformity for the superconducting coils. The overall structure is suitable for the use in movement and other complex wild environments, and has improved anti-interference ability.

In order to suppress the temperature drift of the superconducting coils due to an external thermal disturbance, this invention adopts a rare earth nano-doping process with high heat capacity, in which superconducting coils are vacuum impregnated with a rare earth doped epoxy resin to form a highly-stable superconducting magnet system with high thermal conductivity and high heat capacity.

The above description of this invention is given for illustration and description, but is not exhaustive and is not intended to limit the present invention to the form disclosed herein. Various modifications and variations are apparent for a person of ordinary skill in the art. Embodiments are selected and described for a better illustration of the principle and practical application of this invention, so that those skilled in the art can understand this invention and envisage various embodiments with various modifications suited to specific usages.

What is claimed is:

1. A strong-magnetic focused magnet system for a terahertz source, comprising:

a first superconducting main coil, a second superconducting main coil, a first superconducting correction coil, a second superconducting correction coil, a third superconducting correction coil, and a fourth superconducting correction coil, wherein, the second superconducting main coil surrounds an outer surface of the first superconducting main coil, and the second superconducting main coil is coaxial with the first superconducting main coil;

the first superconducting correction coil surrounds an outer surface of the second superconducting main coil, and the first superconducting correction coil is coaxial with the second superconducting main coil;

the second superconducting correction coil surrounds an outer surface of the first superconducting correction coil, and the second superconducting correction coil is coaxial with the first superconducting correction coil;

the third superconducting correction coil surrounds an outer surface of the second superconducting main coil, in parallel to the first superconducting correction coil in the axial direction of the second superconducting main coil, and the third superconducting correction coil is coaxial with the second superconducting main coil;

the fourth superconducting correction coil surrounds an outer surface of the third superconducting correction coil, and the fourth superconducting correction coil is coaxial with the third superconducting correction coil; and a wire diameter of the first superconducting main coil is larger than a wire diameter of the second superconducting main coil, the wire diameter of the second superconducting main coil is larger than a wire diameter of the first superconducting correction coil, the wire diameter of the first superconducting correction coil is larger than a wire diameter of the second superconducting correction coil, the wire diameter of the second superconducting main coil is larger than a wire diameter of the third superconducting correction coil, and the wire diameter of the third superconducting correction coil is larger than a wire diameter of the fourth superconducting correction coil.

2. The system according to claim 1, wherein, the first superconducting main coil and the second superconducting main coil are cylindrical solenoid coils and are formed of Nb3Sn superconducting wires.

3. The system according to claim 2, wherein, a gap between the outer surface of the first superconducting main coil and an inner surface of the second superconducting main coil is 38 mm.

4. The system according to claim 1, wherein, a gap between an inner surface of the first superconducting correction coil and the outer surface of the second superconducting main coil is 3-7 mm;

a gap between an inner surface of the second superconducting correction coil and the outer surface of the first superconducting correction coil is 2-6 mm;

a gap between an inner surface of the third superconducting correction coil and the outer surface of the second superconducting main coil is 3-7 mm;

a gap between an inner surface of the fourth superconducting correction coil and the outer surface of the third superconducting correction coil is 2-6 mm.

5. A strong-magnetic focused magnet system for a terahertz source, comprising:

a first superconducting main coil, a second superconducting main coil, a first superconducting correction coil, a second superconducting correction coil, a third superconducting correction coil, and a fourth superconducting correction coil, wherein, the second superconducting main coil surrounds an outer surface of the first superconducting main coil, and the second superconducting main coil is coaxial with the first superconducting main coil;

the first superconducting correction coil surrounds an outer surface of the second superconducting main coil, and the first superconducting correction coil is coaxial with the second superconducting main coil;

the second superconducting correction coil surrounds an outer surface of the first superconducting correction coil, and the second superconducting correction coil is coaxial with the first superconducting correction coil;

the third superconducting correction coil surrounds an outer surface of the second superconducting main coil, in parallel to the first superconducting correction coil in the axial direction of the second superconducting main coil, and the third superconducting correction coil is coaxial with the second superconducting main coil;

the fourth superconducting correction coil surrounds an outer surface of the third superconducting correction coil, and the fourth superconducting correction coil is coaxial with the third superconducting correction coil;

a gap between the outer surface of the first superconducting main coil and an inner surface of the second superconducting main coil is 5 mm, a gap between the inner surface of the first superconducting correction coil and the outer surface of the second superconducting main coil is 6 mm, a gap between the inner surface of the second superconducting correction coil and the outer surface of the first superconducting correction coil is 3 mm, a gap between the inner surface of the third superconducting correction coil and the outer surface of the second superconducting main coil is 6 mm, and a gap between the inner surface of the fourth superconducting correction coil and the outer surface of the third superconducting correction coil is 3 mm; and a wire diameter of the first superconducting main coil is larger than a wire diameter of the second superconducting main coil, the wire diameter of the second superconducting main coil is larger than a wire diameter of the first superconducting correction coil, the wire diameter of the first superconducting correction coil is larger than a wire diameter of the second superconducting correction coil, the wire diameter of the second superconducting main coil is larger than a wire diameter of the third superconducting correction coil, and the wire diameter of the third superconducting correction coil is larger than a wire diameter of the fourth superconducting correction coil.

6. The system according to claim 1, further comprising:

a first cathode magnetic field compensation superconducting coil and a second cathode magnetic field compensation superconducting coil, wherein, the first cathode magnetic field compensation superconducting coil is disposed on one end of the first superconducting main coil and the second superconducting main coil in the axial direction;

the second cathode magnetic field compensation superconducting coil is disposed on another end of the first superconducting main coil and the second superconducting main coil in the axial direction.

7. The system according to claim 6, wherein, the first superconducting correction coil, the second superconducting correction coil, the third superconducting correction coil, the fourth superconducting correction coil, the first cathode magnetic field compensation superconducting coil and the second cathode magnetic field compensation superconducting coil are solenoid coils and are formed of NbTi superconducting wires.

8. The system according to claim 7, further comprising:

a plurality of microfluidic heat exchangers, wherein, the microfluidic heat exchangers are wound around the outer surfaces of the first superconducting main coil, the second superconducting main coil, the first superconducting correction coil, the second superconducting correction coil, the third superconducting correction coil, the fourth superconducting correction coil, the first cathode magnetic field compensation superconducting coil and the second cathode magnetic field compensation superconducting coil to increase the heat exchange area of the coil surfaces.

9. The system according to claim 8, wherein, the microfluidic heat exchanger is a metal tube.

10. The system according to claim 9, wherein, the metal tube has a tube outer diameter of 0.5 to 1 mm and is filled with helium gas.

11. The system according to claim 8, further comprising:

distributed solid cold-guide Litz wires, wherein, the distributed solid cold-guide Litz wires are uniformly distributed within the first superconducting main coil, the second superconducting main coil, the first superconducting correction coil, the second superconducting correction coil, the third superconducting correction coil, the fourth superconducting correction coil, the first cathode magnetic field compensation superconducting coil and the second cathode magnetic field compensation superconducting coil.

12. The system according to claim 11, wherein, the distributed solid cold-guide Litz wires are solid metal wires.

13. The system according to claim 12, wherein, the microfluidic heat exchangers and the distributed solid cold-guide Litz wires are connected with a secondary cold head of a refrigerator.

* * * * *